US006722303B2

(12) United States Patent
Lob et al.

(10) Patent No.: US 6,722,303 B2
(45) Date of Patent: Apr. 20, 2004

(54) FAIRLEAD AND CAM ASSEMBLY

(75) Inventors: Chuck Lob, Oconomowoc, WI (US); John Christianson, Milwaukee, WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 10/224,180

(22) Filed: Aug. 20, 2002

(65) Prior Publication Data

US 2004/0035348 A1 Feb. 26, 2004

(51) Int. Cl.[7] ..... B63B 21/04
(52) U.S. Cl. ..... 114/218
(58) Field of Search ..... 114/108, 109, 114/111, 218

(56) References Cited

U.S. PATENT DOCUMENTS 3,815,538 A * 6/1974 Jurgich ..... 114/218

OTHER PUBLICATIONS

Harken, Yacht Equipment, 1995 Catalog, p. 88, Pewaukee, Wisconsin.*

* cited by examiner

*Primary Examiner*—Stephen Avila
(74) *Attorney, Agent, or Firm*—Pyle & Piontek

(57) ABSTRACT

A fairlead and cam cleat assembly for a sailing vessel is provided, in which the fairlead at the entrance of the cam cleat is of inverted U-shape, allowing a line passing through the cam clear to be bent at severe angles relative to center line or normal entrance of the line into the cam cleat.

17 Claims, 3 Drawing Sheets

FAIRLEAD AND CAM ASSEMBLY

BACKGROUND OF THE INVENTION

In general, a "fairlead" is a device used on a sailing vessel to lead and position the running rigging, for example, the lines which are used to control the position and shape of a sail. Fairleads are employed, to prevent excessive binding, friction, and/or chafe on the line that controls the running rigging.

A "cam cleat" is a device widely used on sailing crafts, as well as in other applications requiring a releasable stop. The device generally comprises a base and a pair of cam-shaped toothed jaws or pawls pivotally mounted on the base and movable toward and away from each other, which provides a spacing between the jaws that is variable relative to the center line of the pawls to receive a downward and rearward pulling of the line by the free end to insert the line between the pawls in a locking relationship. The jaws have inwardly facing serrated surfaces and are spring loaded toward a closed position, such that a portion of line inserted from the top of the pawls will be secured toward a closed position. To release the line, the line is pulled up and out of engagement with the pawls. One type of cam cleat currently on the market is described in U.S. Pat. No. 4,453,486, incorporated herein by reference. The pawls rotate around a fixed axis and bearing means, such as a sleeve, ball bearings or roller bearings may be provided to reduce internal friction and to improve performance in terms of insertion and removal of the line in a cleating and uncleating operation.

A cam cleat fairlead currently on the market and sold by Harken, Inc. of Pewaukee, Wis., is shown in FIG. 1. Fairleads such as these may be used at the entry or the exit of the cam cleat to allow the line to maintain alignment between the center line between the pawls of the cleat when the line is disengaged and then engaged again. If the line is not brought into alignment with the pawls, the cam cleat will not operate.

As generally shown in FIG. 1, the prior art conventional assembly comprises a pair of jaws or pawls 10 and 12 pivotally mounted on a base 14. The fairlead comprises a strap, generally shown at 16, mounted above the cam cleat and this strap is designed to retain a line 18 between the jaws or pawls 10 and 12 after the line has been released. In order to allow the line to be released by pulling upwardly, the upper portion of strap 16 includes an upper generally V-shaped notch 20, extending on an angle to vertical, with a pair of spaced vertical bearing tubes or elements 22 and 24 for guiding the line. When this device is positioned at the exit side of the cleat, the free end of the line may be bent at an angle of up to 45 degrees relative to the center line of the cleat, but beyond such angle, as shown in FIG. 1, the line tends to become blocked or hung up by the upper part of notch 20, thus preventing reengagement of the line. This lessens versatility of the cleat and fairlead assembly in terms of where it can be positioned on the sailing vessel in an operative position, and also imposes constraints on the position of the person attempting to cleat the line, since the person may be moving to different positions on the sailing vessel and pulling on the line at an extreme angle.

SUMMARY OF THE INVENTION

The present invention provides a fairlead for a cam cleat, with the fairlead having improvements to allow engagement of the line into the cleat, in situations where the free end of the line being hauled at an angle of more than 45 and preferably more than 90 degrees relative to the centerline between the pawls of the cleat.

The assembly of the present invention comprises a base unit or member for mounting a cam cleat as well as a fairlead near the exit of the cleat. The fairlead comprises a top and an inverted U-shaped tubular or inwardly facing curved member mounted in a fixed position between the top and the base. The inverted U-member or bail extends above the top of the pawls of the cleat to allow the line to be released. Also, the legs of the U-shaped member, which are secured from the base generally vertically and parallel to the top, have a width which is only slightly larger than the largest diameter line that the cam cleat can accept. It will be understood that cam cleats are provided in different sizes and have published specifications of the largest diameter line the cleat will accept. For example, the cleat might be designed to accept a line having a range of diameters of, for example, 3–10 millimeters, so the spacing between the legs of the fairlead would be in excess of 10 millimeters, for example, 11–14 millimeters. The spacing in the upper loop of the bail or inverted U-shaped member would provide even additional clearance to allow release of the line when released from the cleat.

The assembly of fairlead/cam cleat greatly improves the versatility of the assembly in comparison with the prior art, especially in terms of allowing the person or sailor to engage the cleat at extreme angles regardless of the person or sailor. Also, due to the extreme angle engagement feature, the position or location of the cam and fairlead assembly is versatile and is not limited by prior art constraints.

DETAILED DESCRIPTION

Figure 1:
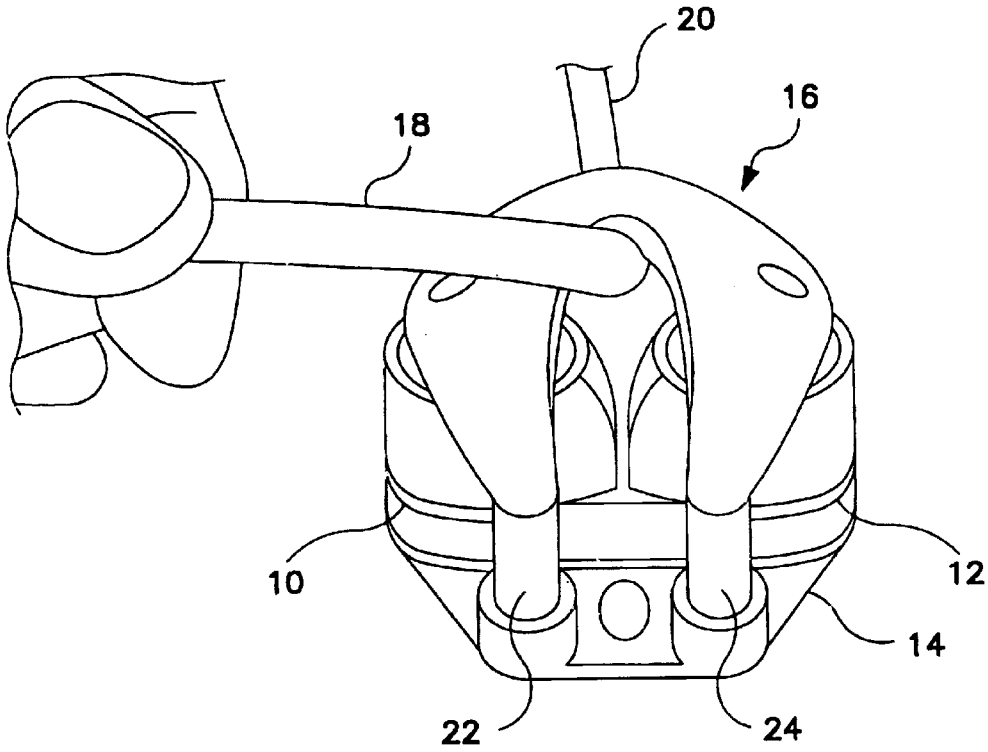
FIG. 1 is a perspective view showing a prior art cam cleat and fairlead combination.
Figure 2:
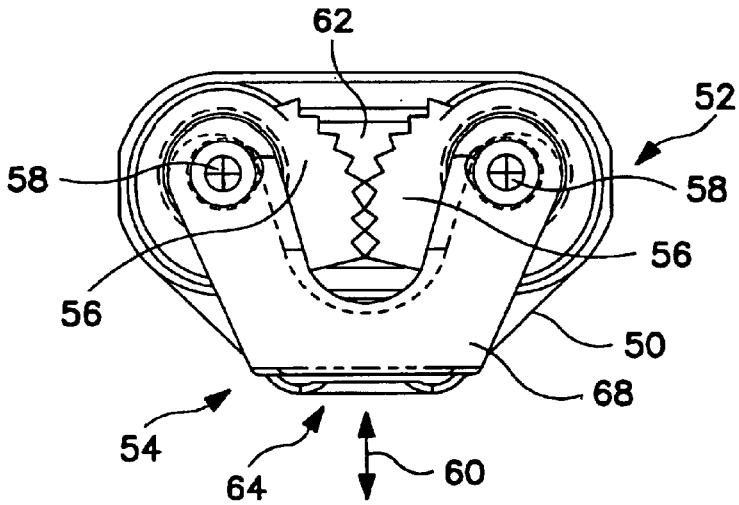
FIG. 2 is a top view of the cam cleat and fairlead assembly of the present invention.
Figure 3:
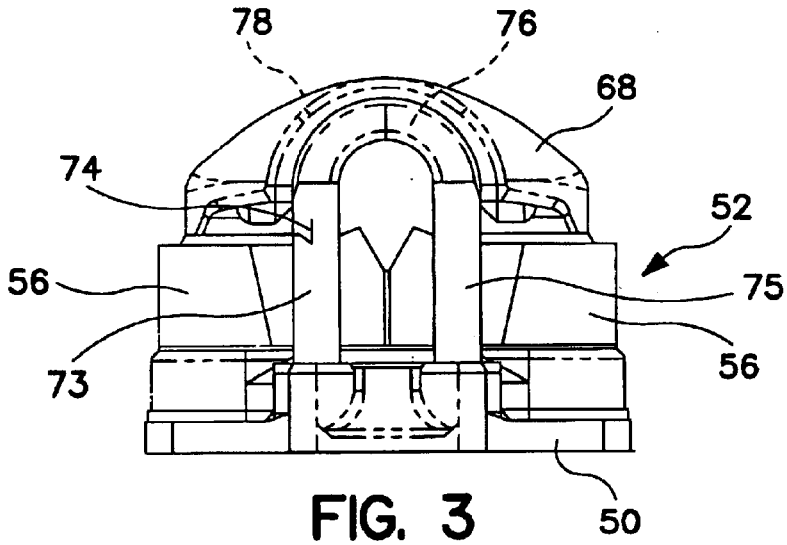
FIG. 3 is a rear end view of the assembly shown in FIG. 2.
Figure 4:
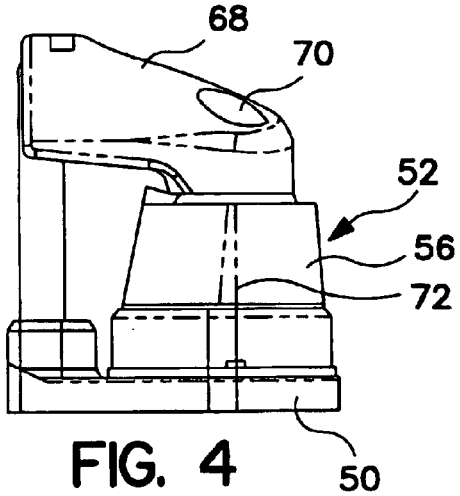
FIG. 4 is a side view of the assembly shown in FIGS. 2 and 3.

FIGS. 2, 3, 4 and 5 illustrate elements of the present invention and the combination of elements and the assembly. As shown, the assembly comprises a base unit 50 which is capable to be secured to a fixed part of a sailing vessel, such as a deck or mast (not show). The base 50 may contain recesses or adaptations to facilitate installation of a conventional cam cleat, generally shown at 52. Preferably, the base 50 also includes a portion for supporting the fairlead, of the present invention, which is generally indicated at 54. The cam cleat 52 and the fairlead 54 may be separately mounted, with the proviso that the alignment shown in the drawings generally prevails.

The cam cleat 52 is conventional in nature, having a pair of opposed spring loaded pawls 56 rotatable about respective posts 58, providing an open and closed position about a centerline 60. The cleat has an entrance side 62 in which the pawls are spaced, and an exit side 64 in which the pawls are narrowly spaced or closed. A line 66 is pulled rearwardly and downwardly from the entrance 62 toward the exit 64 along the centerline 60 to secure the line from forces toward or against the entrance. The line is released by upward tugging out of engagement with the pawls.

The fairlead 54 comprises a top or cap portion 68, which, as shown, has a pair of portions 70 with vertical apertures for securement by a threaded fastener 72 through the pivot axis of each pawl and into or through the base for securement, as a unitized assembly. The cap or top 68 forms an enclosure above and around the cam cleat.

At the rear end of the top 68, an inverted U-shaped member 74 having substantially parallel vertical legs 73 and 75, extends from securement at the base 50 to the top unit 68, with the top unit preferably covering the member 74 to prevent snagging by extraneous lines or interference with other objects. Thus, the upper portion of member 74, namely, the loop 76 portion, as shown, may be received in a recess 78 in the top 68.

The dimensions of the inverted U-shaped member or bail 74 is very important to the present invention. As discussed hereinbefore, all cam cleats are designed to accept, secure, and release lines having a specified range of diameters. A large size cleat, for example, will not adequately grip lines of fine diameter. Most importantly, for the purposes of the present invention, the maximum diameter of line that the cam cleat can accommodate is important.

With regard to the inverted U-shaped member or bail, the overall inner dimensions should be slightly larger than the maximum diameter of line than the cam cleat will accept. The maximum diameter of line is determined not only by the size of the cam cleat, but also by the maximum size of the pawls of the cleat when in a fully open or receiving position. The cleats have internal stops which absolutely prevent outer or separation rotation for accepting a line, and if this limit is exceeded, the cleat is inoperable.

Figure 5:
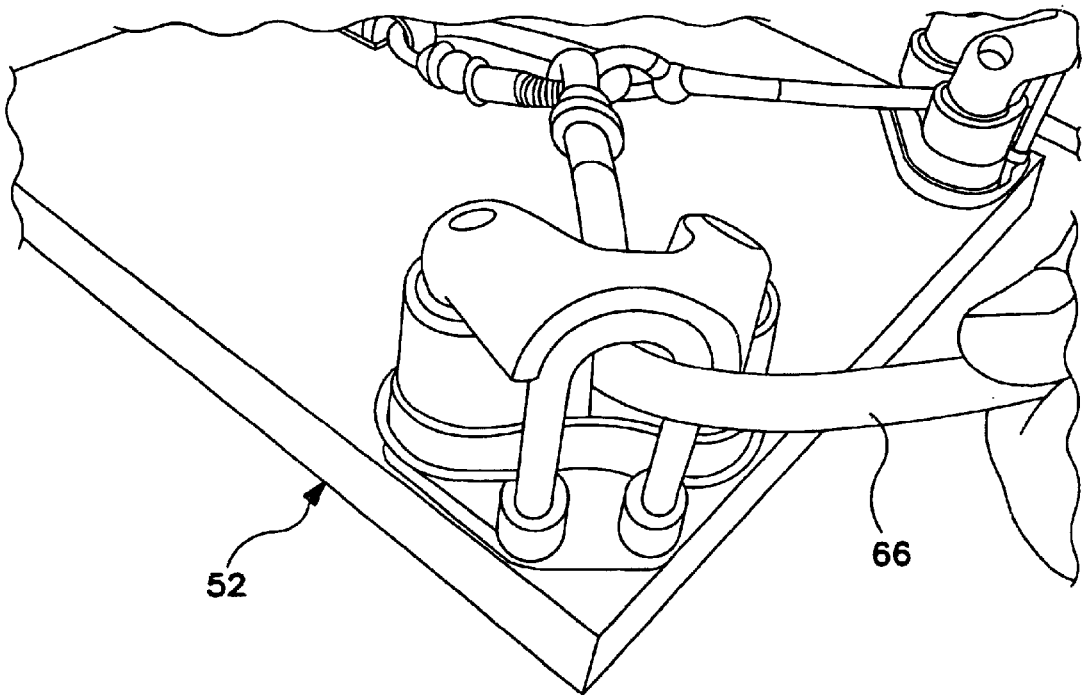
FIG. 5 is a perspective view of the combination shown in FIGS. 2–4, additionally illustrating entry of a line, through the fairlead.

FIG. 5 shows the present invention in operation, in which the line is being pulled around the bail at an extreme angle. The line will not bind, and especially of the bail is constructed of stainless steel or other material having a smooth surface, such as stainless steel rod or the equivalent having a low friction bearing surface for the line.

What is claimed is:

1. A cam cleat and fairlead assembly for receiving a line having a free end, said assembly comprising a cam cleat having a center line of a forward engagement and free line disengagement portions, and a maximum diameter of a line acceptable for engagement, and a fairlead associated with the said cam cleat spaced behind said disengagement portion for holding said line in approximate alignment with the center line of the cam cleat, said fairlead comprising the improvement wherein said fairlead comprises an inverted U-shaped member having dimensions to cleat and uncleat the line, said fairlead having dimensions permitting said free end of said line to be hauled at an angle of more than 45° to the center line of the cam cleat and released from said cam cleat but yet permit the line to be re-engaged with said cam cleat.

2. The assembly of claim 1, wherein said dimensions are larger than the maximum diameter of the line engageable by the cam cleat.

3. The assembly of claim 1, wherein the assembly comprises a base for securement to a support.

4. The assembly of claim 1, wherein said inverted U-shaped member has one or more leg portion and a loop portion said one or more leg portion and said loop portion all being at one side of said cam cleat.

5. The assembly as in claim 4, wherein said loop is spaced relatively above and to said one side of said cam cleat.

6. The assembly as in claim 4, wherein no part of said loop portion extends directly relatively above any part of said cam cleat.

7. The assembly as in claim 5, wherein no part of said loop portion extends directly relatively above any part of said cam cleat.

8. The assembly as in claim 7, further comprising a cap portion extending from said loop portion to relatively above said cam cleat.

9. The assembly as in claim 8, wherein said cap portion is secured to said cam cleat.

10. The assembly as in claim 1, wherein said fairlead has dimensions permitting said free end of said line to be hauled at an angle of more than 90° to the center line of said cam cleat and released from said cam cleat but yet permit the line to be re-engaged with said cam cleat.

11. The assembly as in claim 1, wherein said inverted U-shaped member is generally perpendicular to said center line.

12. A cam cleat and fairlead assembly for receiving a line having a free end, said assembly comprising a cam cleat having a center line of a forward engagement and free line disengagement portions, and a maximum diameter of a line acceptable for engagement, and a fairlead associated with the said cam cleat spaced behind said disengagement portion for holding said line in approximate alignment with the center line of the cam cleat, said fairlead comprising the improvement wherein said fairlead comprises an inverted U-shaped member having dimensions to cleat and uncleat the line, said U-shaped member having two legs and a top relatively above and connecting the two legs, the top being located relatively above and relatively in front of the hand side of the cam cleat so that if the tail of the line is held along the side of the cam cleat, the line may still be engaged in the cam cleat by moving the tail relatively downward to cause the line to engage in said cam cleat.

13. The assembly of claim 12, wherein said fairlead is dimensioned to cause the tail of the line held along the side of the cam cleat to be disengaged from the cam cleat by moving the tail relatively upwardly to cause the line to disengage from said cam cleat.

14. The assembly of claim 12, wherein said legs and top of said U-shaped member are in a plane.

15. The assembly of claim 14, wherein said plane is generally perpendicular to said center line.

16. The assembly of claim 13, wherein said legs and top of said U-shaped member are in a plane.

17. The assembly of claim 16, wherein said center line is generally perpendicular to said plane.

* * * * *